United States Patent [19]

Kostopoulos

[11] Patent Number: 4,957,127

[45] Date of Patent: Sep. 18, 1990

[54] PAINT ROLLER COVER APPLICATOR CLEANING APPARATUS

[76] Inventor: George P. Kostopoulos, 26 Ruth St., Trumbull, Conn. 06611

[21] Appl. No.: 438,716

[22] Filed: Nov. 17, 1989

[51] Int. Cl.[5] ..... B08B 3/04

[52] U.S. Cl. ..... 134/117; 68/213; 134/182

[58] Field of Search ..... 68/213; 134/117, 182, 134/183

[56] References Cited

U.S. PATENT DOCUMENTS

| | | | |
|---|---|---|---|
| 2,542,491 | 2/1951 | Engel | 68/213 X |
| 2,794,264 | 6/1957 | Scholtka | 34/8 |
| 2,794,265 | 6/1957 | Kruger | 34/58 |
| 3,252,174 | 5/1966 | Schoepske, Jr. | 15/1 |
| 3,421,527 | 1/1969 | Dettman | 134/138 |
| 4,126,484 | 11/1978 | Monteiro | 134/34 |
| 4,155,230 | 5/1979 | Lacher, Jr. | 68/213 |
| 4,377,175 | 3/1983 | Fritz | 134/138 |
| 4,380,478 | 4/1983 | Cooney | 134/38 |
| 4,401,476 | 8/1983 | Klaiber | 134/33 |

*Primary Examiner*—Philip R. Coe

*Attorney, Agent, or Firm*—Parmelee, Bollinger & Bramblett

[57] ABSTRACT

A cylindrical paint roller cover applicator having a hollow body member supporting a paint-absorbing layer is plugged and inserted in the cleaning apparatus which comprises a cylindrical sleeve having an inside diameter sligtly smaller than the outside diameter of the applicator. A first end cap having a central opening therein is frictionally mounted on one end of the sleeve and has a central opening adapted to couple a water supply thereto. A coupler is frictionally mounted on the other end of the cylindrical sleeve which contains a bayonet socket which is adapted to removably house a second end cap having a plurality of bayonet studs equally spaced around the periphery which may be removably inserted and locket in the bayonet socket of the coupling. The second end cap has a central opening to which a discharge hose is connected whereby water which is fed through the first end cap and forced through the paint-absorbing layer of the applicator for cleaning the applicator is discharged from the central opening and directed by the discharge hose attached thereto for the orderly disposal of the paint-polluted water from the cleaning apparatus.

3 Claims, 3 Drawing Sheets

PAINT ROLLER COVER APPLICATOR CLEANING APPARATUS

BACKGROUND OF THE INVENTION

This invention relates to paint roller cover applicator cleaning apparatus, and more particularly to such an apparatus which centrally conducts and discharges paint-polluted liquid through a central discharge path in order to simplify disposal of the polluted water, and thus simplify the cleaning process.

A number of approaches have been taken in the prior art for cleaning removable paint roller cover applicators which are mounted on a cylindrical frame for rotation on a suitable handle. The paint roller cover applicator may have a semi-rigid or flexible tubular liner of plastic, cardboard or other material which is surrounded with an outer annular layer of absorbent material or nap which is dipped in paint and adapted to retain the paint until it is rolled on the surface to be painted. The cover applicators are removable from the paint roller and must be cleaned to be used again. The better cover applicators which have superior absorbent layers or naps are generally too expensive and/or good to throw away after each use, and may be cleaned principally with water for water-soluable paints.

One method of cleaning the cover applicators is illustrated in U.S. Pat. No. 4,126,484 in which the entire roller with the applicator mounted thereon is inserted in a cylindrical body having an inside diameter of the size to snugly and slideably receive the paint roller therein with a hook on the open end to hold the roller therein once it has been inserted. A liquid under pressure is admitted from the opposite end of insertion so that the liquid is forced through the nap of the cover mounted on the roller. The problem with this approach is that the paint roller itself may not properly plug the ends of the cover applicators so that all of the liquid is not forced around the outer periphery of the cover. In addition, the discharge from the open end is only restricted by the complete open end of the cleaning cylinder and portions of the handle are in the way resulting in a very messy process with the polluted discharge water carrying the paint simply spews out of the complete open end of the cleaning cylinder.

Another approach of a similar type is shown in U.S. Pat. No. 4,155,230 in which the cylindrical roller cover applicator of absorbent material fits snugly in a cylindrical casing with one end of the cylindrical roller cover applicator being plugged before the applicator which has been removed from its roller is inserted into the cylindrical casing. The other end of the applicator as well as the cylindrical casing in which the applicator has been inserted is closed with discharge openings communicating with the interior of the casing adjacent the inner periphery thereof. Thus, the end cap has a plurality of openings on the outer periphery thereof which receive the polluted water which is discharged around the entire end cap making for a difficult and messy discharge of the polluted water. Then too, if any of the openings become clogged, the cleaning process is deterred. In addition, the end cap is required to plug one end of the paint applicator and to do so it must be flush against the open end of the paint cover applicator or the pressure from the discharge water will enter the inside of the paint roller cover applicator weakening or destroying its tubular lining and/or depositing water containing paint on the interior of the tube which prevents a thorough cleaning job. Thus, this type of paint roller cleaner requires the exact size of tubular casing for the particular length of the paint roller cover applicator which is being cleaned. The tubular casing which holds the cover applicators thus has no flexibility to handle varying length cover applicators for cleaning.

The present invention is directed to improving the type of paint roller cover applicator cleaners which have been described and in overcoming some of the problems associated therewith.

SUMMARY OF THE INVENTION

Accordingly, it is an object of the present invention to provide an improved paint roller cover applicator cleaning apparatus which overcomes the problems with such apparatus as described above and further provides for the orderly discharge of the paint-polluted water which has been used to clean the paint cover applicator.

Another object of this invention is to provide a new and improved paint roller cover applicator cleaning apparatus which is simple in construction, easy to use, and inexpensive.

Still another object of this invention is to provide a new and improved paint roller cover applicator cleaning apparatus which will accommodate different length cover applicators and will provide for the orderly collection in directing the polluted discharge water away from the applicator where it can be conveniently disposed of in a drain, sink, toilet, basin, etc. without completely covering and requiring cleaning of the place where the paint polluted water is being disposed of.

In carrying out this invention in one illustrative embodiment thereof, a paint roller cover applicator cleaning apparatus for cleaning a hollow, cylindrical, paint roller cover applicator of the type having a body member supporting a paint absorbing layer with the hollow body member being plugged at both ends prior to insertion in the apparatus. The cleaning apparatus comprises a cylindrical sleeve housing having an inside diameter slightly smaller than the outside diameter of the paint roller cover applicator to be cleaned by the apparatus. A first end cap having a central opening therein which is adapted to couple a water supply to the apparatus is frictionally mounted on one end of the sleeve housing. A coupling means having a first end frictionally mounted on the other end of the cylindrical sleeve housing carries a second end having a bayonet socket positioned therein adapted to removably house a second end cap therein. A second end cap has plurality of bayonet studs equally placed around the periphery thereof which is adapted to be removably inserted and locked in the bayonet socket of the coupling means. The second end cap has a central opening adapted to receive a discharge hose wherein the water is forced through the paint-absorbing layer of the applicator placed in the apparatus for cleaning with the water being discharged from the central opening of the second end cap and thereby directed by a discharge hose attached thereto for the orderly disposal of the paint-polluted water discharged from the apparatus.

With each end of the hollow paint roller cover being plugged, the cylindrical sleeve housing may be of sufficient length to accommodate different lengths of paint roller cover applicators. Since both ends of the applicators are plugged prior to insertion in the cylindrical sleeve housing, either the water being inserted in one end or the polluted water being discharged from the other end will be prevented from entering the hollow cover applicator.

BRIEF DESCRIPTION OF THE DRAWINGS

The invention, together with further objects, aspects, features and advantages thereof will be more clearly understood from the following description taken in connection with the accompanying drawings.

DESCRIPTION OF THE PREFERRED EMBODIMENTS

Figure 1:
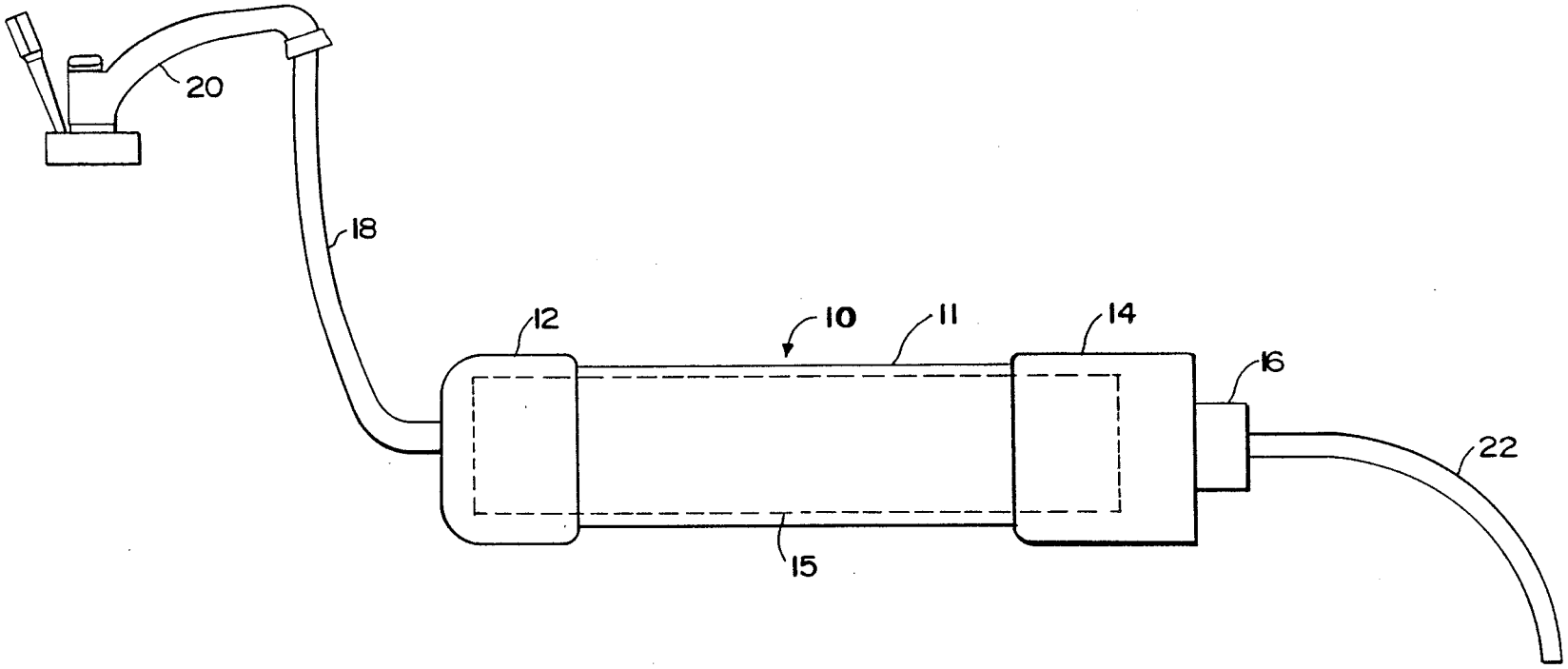
FIG. 1 is an assembled paint roller cover applicator cleaning apparatus in accordance with the present invention shown coupled to a water supply for cleaning a paint roller cover applicator shown in phantom in the assembled apparatus.

Referring now to FIG. 1, a paint roller cover applicator cleaning apparatus referred to generally with the reference numeral 10, has a cylindrical sleeve housing 11 and a first end cap 12, a coupling means 14 and a second end cap 16. As illustrated in FIG. 1, a paint roller cover applicator 15 (shown in phantom) is inserted in the cleaning apparatus 10. The first end cap 12 is coupled by a hose 18 to a faucet 20 for applying pressurized water to the cleaning apparatus 10. The pressurized water is applied through the outer paint-absorbing layer (not shown) of the cover applicator 15 for cleaning the applicator with the paint-polluted water exiting the second end cap 16 through a discharge hose 22 which will guide the polluted water to any suitable disposal means such as a sewer, drain, toilet, etc.

Figure 2:
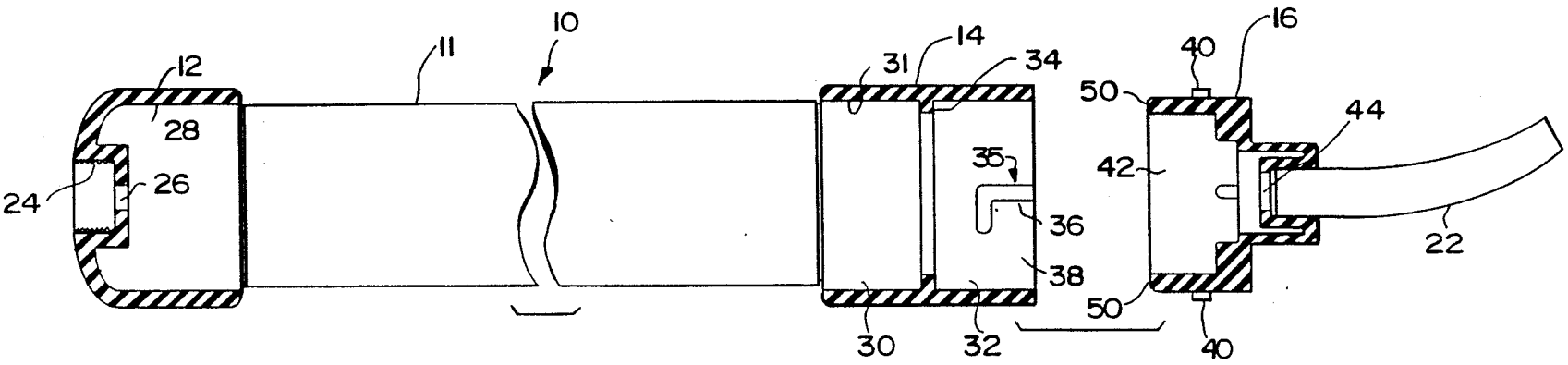
FIG. 2 illustrates a disassembled view of the cleaning apparatus shown in FIG. 1 partly in section and with the cylindrical sleeve housing broken away.

In FIG. 2 it will be seen that the cleaning apparatus includes a cylindrical sleeve housing 11 which has an inside diameter which is slightly smaller than the outside diameter of a paint roller cover applicator which is to be inserted therein and cleaned by the apparatus. It should be understood that the tubular lining of the applicator 15 will always have a diameter which is smaller than the internal diameter of the sleeve housing so that the applicator will fit into the housing. However, the nap on the applicator may vary depending on the material of the nap. Even if the nap is slightly larger than the inside diameter, the applicator 15 will still fit. The cylindrical sleeve housing 11 will be long enough to accommodate standard sized roller cover applicators of 9 and 12 inches in length. The applicator 15 which is only shown in phantom in FIG. 1, is generally formed of an elongated tubular member of rigid to semi-rigid material of plastic or other suitable material which is covered by a paint-absorbent layer or nap of suitable material for retaining the paint until it is rolled on a painting surface.

Figure 3:
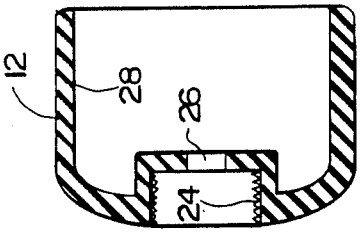
FIG. 3 is a cross-sectional view of the first end cap for closing one end of the cylindrical sleeve housing of the apparatus.
Figure 4:
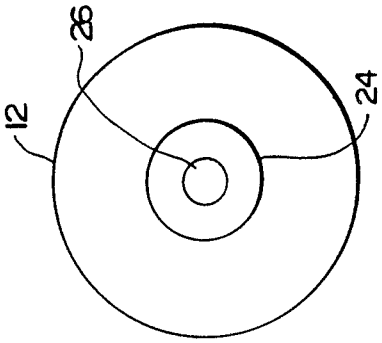
FIG. 4 is a top view of the first end cap shown in FIG. 3.

The applicator 15 will generally be inserted axially into the cylindrical sleeve housing 11 of the cleaning apparatus 10. One end of the cylindrical sleeve housing 11 is covered by a first end cap 12 also illustrated in FIGS. 3 and 4 having a threaded socket 24 therein adapted to receive a hose coupling of the input hose 18 for receiving a water supply from the tap 20 as shown in FIG. 1. The first end cap 12 has an opening 26 therein for applying pressurized water from the faucet 20 through the input hose 18 into the first end cap 12. The first end cap has an inside diameter 28 of approximately the same size as the external diameter of the sleeve housing 11 such that the end cap 12 is frictionally positioned on one of the cylindrical housing 11 and held thereon in tight frictional engagement therewith.

Figure 5:
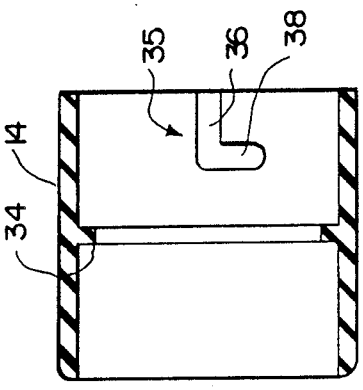
FIG. 5 is cross-sectional view of a coupling means mounted on the other end of the cylindrical sleeve housing as illustrated in FIG. 2.
Figure 6:
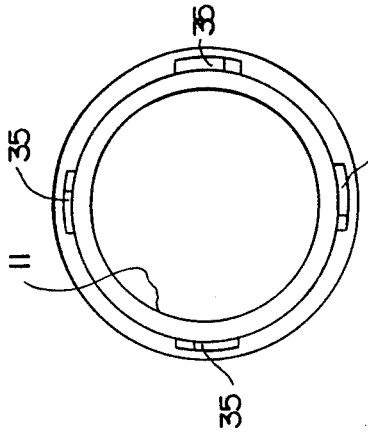
FIG. 6 is a right side end view of FIG. 5.

The coupling means 14 as illustrated in FIGS. 2, 5 and 6 has a first socket 30 therein and a second bayonet socket 32 therein separated by an annular flange 34. The inside diameter 31 of the first socket 30 in the coupling means 14 is substantially the same size as the outer diameter of the cylindrical sleeve housing 11 with the coupling means 14 fitting on the sleeve 11 on the end opposite the first end cap 12 in frictional engagement with the sleeve. The sleeve housing 11 will rest on flange 34 to which the end of the sleeve housing may be secured by any suitable adhesive, if desired. The bayonent socket 32 has a plurality of passageways 35 therein, the first section having a straight in groove 36 joined by a second substantially right angle groove 38 which has a 5% slope therein. As will be seen in FIG. 6, a plurality of grooves 35 are shown spaced equally on the inside surface of the bayonet socket 32 which are adapted to receive and retain bayonet studs or lugs 40 therein.

Figure 10:
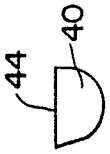
FIG. 10 is an enlarged top view of one of the studs on the second end cap.
Figure 7:
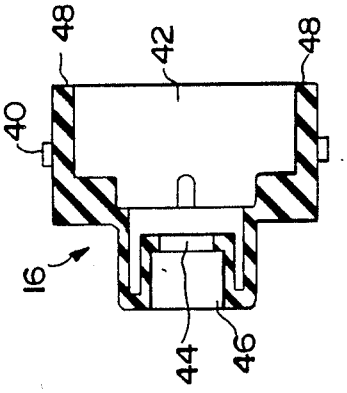
FIG. 7 is a cross-sectional view of the second end cap of the apparatus shown in FIG. 2.
Figure 8:
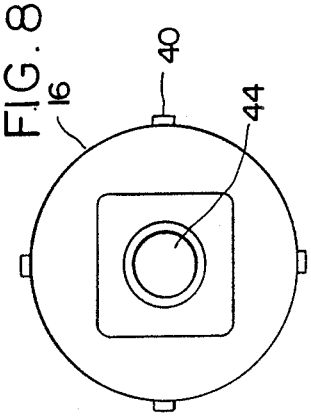
FIG. 8 is a left side end view of the second end cap as illustrated in FIG. 7.
Figure 9:
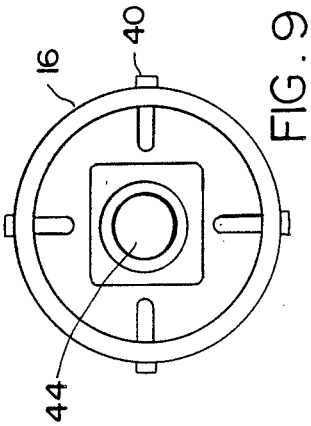
FIG. 9 is a right side end view of the second end cap as shown in FIG. 7.

The second end cap 16 as shown in FIGS. 2, 7, 8 and 9 includes a plurality of bayonet studs 40 protruding from the outer surface thereon as will be seen in FIGS. 8 and 9 which are equally spaced around the outer periphery of the second end cap 16. The studs 40 are shown in FIG. 10 having a flat face 41 with a 5% angle or slope matching the 5% slope in the grooves 38 of passageways 35. An O-ring 50 (FIG. 2) is mounted in an annular groove 48 (FIG. 7). Accordingly, the slope of the passageways 35 and the studs 40 are such that when the second end cap 16 is inserted in the socket 35 and rotated, the studs lock the end cap 16 in the socket 32 compressing the O-ring 50 against the flange 34 of the coupler 14 thereby providing a good seal. The second end cap 16 has a receiving chamber 42 therein with a central opening 44 therethrough and an exit receptacle 46 for receiving and retaining an exit discharge hose 22 thereon.

In operation, the end cap 12 is mounted on the sleeve housing 11 on one end thereof and the coupling means !4 is mounted on the other end of the sleeve 11. A roller applicator which is desired to be cleaned is plugged-up at both ends so that the cleaning fluid does not come into contact with the inside diameter of the rigid or semi-rigid support on which the nap of the cleaning applicator 15 is mounted. The end cap 16 is the inserted in the socket 32 of the coupling means 14 with the four bayonet studs aligned with the straight in grooves 36. When all four of the lugs 40 have been inserted the full length of the grooves 36, the second end cap 16 is rotated to lock the studs in the ends of the 5% slope grooves 38. The O-ring 50 is compressed providing a good seal between the end cap 16 and the coupler 14. A water supply source, if not already attached in the threaded socket 32 of the first end cap 12, is connected and the water is turned on whereby water under pressure is admitted into the closed end of the cylindrical sleeve housing 11 by the first end cap 12. It is assumed that the roller has used water-soluble paint which is to be removed therefrom. The water is then forced to pass through the nap layer of the applicator 15 which flushes the water-based paint from the nap layer through the coupling 14 which is collected in the chamber 42 of the end ca 16 and discharged through the opening 44 into the exit hose 22. The benefit of this end cap 16 is that the paint-polluted water is collected and applied through an exit hose where it can be directed for disposal which eliminates the messy discharge of polluted water through a plurality of openings or a single open-ended housing in the manner previously achieved in the prior art.

Accordingly, a paint roller cover applicator cleaning apparatus is provided which is simple in construction, which may easily be utilized by a novice and which performs a very credible job of cleaning a paint cover applicator. The cleaning apparatus can accommodate standard lengths of paint rollers without complicated construction or telescoping to elongate the housing. The single collection chamber, which guides the polluted water, simplifies what ordinarily resulted in a very messy clean-up job.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A paint roller cover applicator cleaning apparatus for cleaning a hollow, cylindrical paint roller cover applicator of the type having a hollow body member supporting a paint absorbing layer with the hollow body member being plugged prior to insertion in the apparatus for cleaning comprising:

a cylindrical sleeve housing having an inside diameter slightly smaller than the outside diameter of a paint roller cover applicator to be cleaned by the apparatus;

a first end cap having a central opening therein adapted to couple a water supply to said apparatus mounted on one end of said sleeve;

a coupling means having a first end frictionally mounted on the other end of said cylindrical sleeve housing and a second end having a bayonet socket positioned therein adapted to removably house a second end cap therein;

a second end cap having a plurality of bayonet studs equally spaced around the periphery adapted to be removably inserted and locked in said bayonet socket of said coupling means;

said second end cap having a central opening therein coupled to a discharge hose whereby water is forced through the paint absorbing layer of an applicator placed in said apparatus and the water is discharged from the central opening of said second end cap by said discharge hose for the orderly disposal of the guided paint polluted water from the apparatus.

2. The apparatus as claimed in claim 1 wherein said bayonet socket has a plurality of shaped slots therein adapted to receive said bayonet studs therein and to lock said second end cap therein by rotating said second end cap after said studs have been inserted in said bayonet socket.

3. The apparatus as claimed in claim 2 wherein said second end cap has an O-ring mounted therein for engagement with said coupling means when said second end cap is inserted therein, said shaped slots having a 5% slope on one portion thereof and said studs having a flat face with a 5% slope thereon complimentary to said 5% slope in said grooves for locking said second end cap in said socket and compressing said O-ring for providing a seal between said coupling means and said second end cap.

* * * * *